United States Patent [19]

Wright

[11] Patent Number: 4,775,030

[45] Date of Patent: Oct. 4, 1988

[54] TREE STEP

[76] Inventor: Benjamin W. Wright, 12479 Wallace Dr., Clio, Mich. 48420

[21] Appl. No.: 148,245

[22] Filed: Jan. 25, 1988

[51] Int. Cl.[4] ..... A63B 27/00; A63B 29/04

[52] U.S. Cl. ..... 182/92; 182/228

[58] Field of Search ..... 182/90, 91, 92, 87, 182/228, 189, 100

[56] References Cited

U.S. PATENT DOCUMENTS

| | | | |
|---|---|---|---|
| 907,483 | 12/1908 | Ette | 182/91 |
| 3,298,459 | 1/1967 | Bergsten | 182/92 |
| 3,380,697 | 4/1968 | Melcher | 182/92 |
| 3,498,409 | 3/1970 | Meyer | 182/92 |
| 4,413,706 | 11/1983 | Michael | 182/92 |
| 4,415,061 | 11/1983 | Meyer | 182/92 |
| 4,669,575 | 6/1987 | Skyba | 182/92 |
| 4,697,669 | 10/1987 | Bergsten | 182/92 |
| 4,700,807 | 10/1987 | Kubiak | 182/92 |

*Primary Examiner*—Reinaldo P. Machado
*Attorney, Agent, or Firm*—Donald C. Bolger

[57] ABSTRACT

An inexpensive tree step is provided that permits a hunter to climb a tree and then remove a portion of the assembly so that the hunters tree stand or steps cannot be stolen.

This is accomplished by using a conical pointed screw with a threaded countersunk head which can receive another screw which can easily be connected and disconnected. The unit can also be made of special type treads and special type head.

To use the tree step, the hunter merely turns the screw portion into the tree. This conical screw is left in the tree for the duration of the hunting season or until the hunter no longer desired this location. The step portion of the tree step is carried into and out of the woods each day. The threads can be made special so that no other hunter could use a lag bolt or other commercial bolts to attach to the screws in the tree. The step portion also has a handle on the end to act as a stop for the hunter's foot and as a handle to insert and remove the step from the screw. This handle permits the step to be turned into the screw without additional tools.

14 Claims, 1 Drawing Sheet

TREE STEP

BACKGROUND OF THE INVENTION

This invention pertains to climbing equipment, and more particularly to apparatus for assisting people who hunt deer and other game to climb trees.

Over the years many hunters have found that there is an advantage in hunting by using a tree stand or by sitting on the limb of a tree. However, some trees are difficult to climb.

To hunt from a tree, a hunter must find a tree that has many branches and is easy to climb. If such a tree cannot be found in the desired area, he must use other means to climb the tree.

A ladder could be used on some trees, however, it is difficult to take into a woods and often the ladder may not be the right size for a tree that the hunter would like to climb. Pole climbing boots or spikes may be difficult for an inexperienced climber and could result in injury.

Over the years, hunters have turned to mechanical type steps with various screw type arrangements that could be secured into the tree making it safer to climb.

In some areas, theft of tree stands and/or tree steps is a increasing problem for the hunter. Many tree stands are expensive and so are tree steps which can easily be stolen.

One solution is to remove the tree steps and take the steps home, however, repeatedly turning a screw type fastener in and out of a tree wears the threads formed in the tree, making it dangerous to climb.

There is a need for a inexpensive tree step that is safe and can assist hunters in climbing trees and then easily removing the step when the hunter leaves the woods.

SUMMARY OF THE INVENTION

In accordance with the present invention, an inexpensive tree step is provided that permits a hunter to climb a tree and then remove a portion of the assembly so that the tree stand or steps cannot be stolen.

This is accomplished by using a conical pointed screw with a threaded countersunk head which can receive another screw which can easily be connected and disconnected. The unit can also be made of special type treads and special type head so that it would be difficult for another person to steal because it would be unlikely that the other hunter would not have the correct tools with him.

To use the tree step, the hunter merely turns the screw portion into the tree. This conical screw is left in the tree for the duration of the hunting season or until the hunter no longer desired this location. The step portion of the tree step is carried into and out of the woods each day. The threads can be made special so that no other hunter could use a lag bolt or other commercial bolts to attach to the screws in the tree. The step portion also has a handle on the end to act as a stop for the hunter's foot and as a handle to insert and remove the step from the screw. This handle permits the step to be turned into the screw without additional tools.

It is an object of this invention to improve upon the prior art and provide a device in which a screw is temporarily attached to a tree or post which has a head to receive another screw.

It is another object of this invention to have special threads discourage theft or improper use.

It is a further object of this invention to provide a screw which can be temporarily attached to several trees and having the hunter only carrying one set of steps with him.

It is another object of this invention to have a quick drive self tapping screw pitch on a tree spike.

It is a further object of this invention to use anodized steel for less expense and rust resistance.

It is another object of this invention to use a full knurling on each step for a safety grip.

It is a further object of this invention to use a quick turn knob on each step which also serves as a safety stop for feet and hands.

It is another object of this invention to use a heat treated tree support screw and step for safety.

It is a further object of this invention to use left hand metric threads on the step for additional security.

It is another object of this invention to use a metric or special head on the screw so it can not be easily stolen.

It is a further object of this invention to use an end plate on the step slotted on each corner for easy and confident use in light or dark climbing conditions.

It is another object of this invention to use a teflon coating on the screw for easy installation and removal.

It is a further object of this invention to use reflective tape on the screw head so that it can be seen at night.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
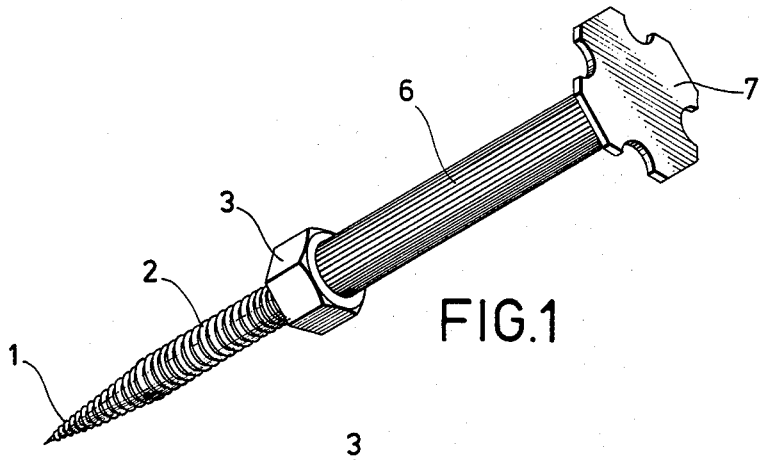
FIG. 1 is a perspective view of the tree step assembled.

Referring to FIG. 1, a tree step is illustrated that includes the present invention. The tree step is particularly useful to hunters for climbing to there tree stands, but it will be understood that the invention is not limited to hunting related activities.

The tree step comprises a conical screw portion 1, a screw 2, a screw head 3, a threaded countersunk portion 4, a threaded step portion 5, a knurled step portion 6, a step handle 7, and a handle cut out portion 8.

Figure 2:
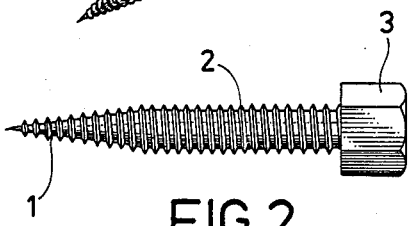
FIG. 2 is a side view of the screw.

As best shown in FIG. 2, screw 2 has a conical portion 1 so that it can easily be started into a tree. Screw 2 also has a head 3 that is hexagonal. A socket wrench or adjustable end wrench can be used to turn screw 2 into a tree.

Figure 3:
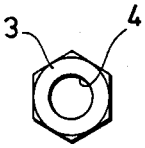
FIG. 3 is an end view of the screw.

As best shown in FIG. 3, threaded countersunk portion 4 acts as an coupler and can have either standard or special threads to receive threaded step portion 5.

Figure 5:
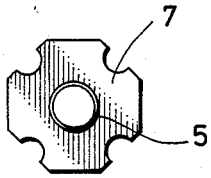
FIG. 5 is an side view of the step.
Figure 6:
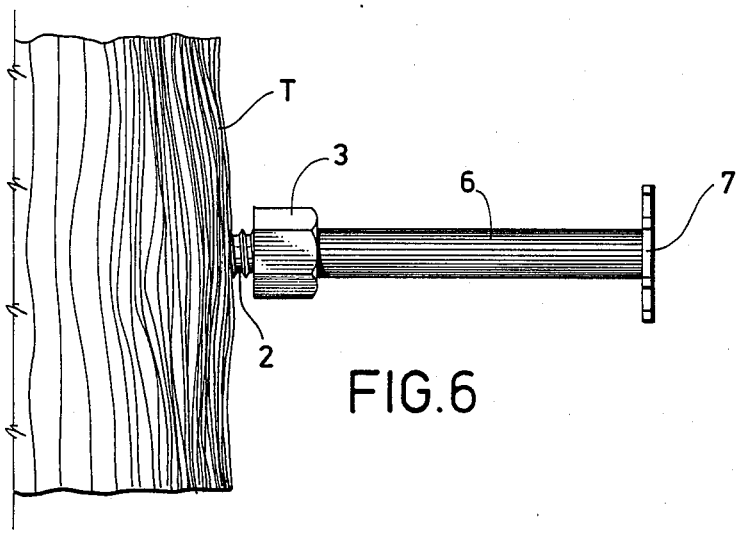

As best shown in FIG. 5, threaded step portion 5 have threads to match the threaded countersunk portion 4. The knurled step portion 6 acts as a step and has knurling so that it will be less likely for one to slip on the step. The step handle 7 acts as a special head and also helps to stop one's foot from sliding outward.

Figure 4:
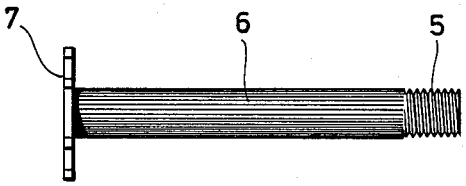
FIG. 4 is an end view of the step.

As best shown in FIG. 4, step handle 7 has a handle cut out portion 8.

To use the tree step, the screw 2 is turned into the tree by using a socked wrench on screw head 3 and turning the screw into the tree. Next, the threaded step portion 5 is turned into the threaded countersunk portion 4 by turning on handle 7 until the step is tight. The step may then be used.

To temporarily dismantle, handle 7 is turned in the reverse direction and the step portion 5,6,7,8 is removed.

To permanently dismantle, screw 2 is turned in the reverse direction and the screw 2 is removed from the tree.

Thus, it is apparent that there has been provided, in accordance with the invention, a tree step that fully satisfies the objects and advantages set forth above. While the invention has been described in conjunction with specific embodiments thereof, it is evident that may alternatives, modifications, and variation will be apparent to those skilled in the art in light of the foregoing description. Accordingly, it is intended to embrace all such alternatives, modifications, and variations as fall within the spirit and broad scope of the appended claims.

What is claimed is:

1. A tree step comprising:

a screw having a conical point and a head with an axial countersunk portion;

a step having an engaging portion, a knurled portion, and a handle portion;

means for connecting the step to the screw.

2. The tree step of claim 1 wherein:

the head of the screw has threaded countersunk portion;

the engaging portion of the step has a threaded portion.

3. The tree step of claim 1 wherein:

the head of the screw has a metric threaded countersunk portion;

the engaging portion of the step has a metric threaded portion.

4. The tree step of claim 1 wherein:

the head of the screw has a left hand metric threaded countersunk portion;

the engaging portion of the step has a left hand metric threaded portion.

5. The tree step of claim 1 wherein:

the screw has a quick drive self tapping pitch.

6. The tree step of claim 1 wherein:

the screw and step are made from anodized steel.

7. The tree step of claim 1 wherein:

the step portion has a full knurl.

8. The tree step of claim 1 wherein:

a means to turn the step is attached to the end opposite to the engaging end.

9. The tree step of claim 1 wherein:

a plate is attached on the end opposite to the engaging end.

10. The tree step of claim 1 wherein:

the screw and step are heat treated.

11. The tree step of claim 1 wherein:

left hand metric threads are use as the engaging means.

12. The tree step of claim 1 wherein:

the screw head is metric with a reflective material attached.

13. The tree step of claim 1 wherein:

the screw is teflon coated.

14. A tree step comprising:

a screw having a conical point and a head with an axial threaded internal countersunk portion;

a step having a external threaded portion which threads match said threaded internal countersunk portion, a knurled portion, and a handle portion;

means for attaching and removing said screw and step.

* * * * *

UNITED STATES PATENT AND TRADEMARK OFFICE

CERTIFICATE OF CORRECTION

PATENT NO. : 4,775,030

DATED : Oct. 4, 1988

INVENTOR(S) : Benjamin F. Wright

It is certified that error appears in the above—identified patent and that said Letters Patent is hereby corrected as shown below:

In [76] Inventor: The Inventor's middle initial "W" is deleted and a --F--is inserted.

Signed and Sealed this

Thirteenth Day of June, 1989

*Attest:*

DONALD J. QUIGG

*Attesting Officer*

*Commissioner of Patents and Trademarks*